US009382708B1

(12) United States Patent
Perdue

(10) Patent No.: US 9,382,708 B1
(45) Date of Patent: Jul. 5, 2016

(54) DEVICE FOR ACOUSTICAL CHARACTERISTICS MODIFICATION

(71) Applicant: Joab Jay Perdue, Amarillo, TX (US)

(72) Inventor: Joab Jay Perdue, Amarillo, TX (US)

( * ) Notice: Subject to any disclaimer, the term of this patent is extended or adjusted under 35 U.S.C. 154(b) by 0 days.

(21) Appl. No.: 14/485,053

(22) Filed: Sep. 12, 2014

(51) Int. Cl.
*E04B 1/342* (2006.01)
*E04B 1/84* (2006.01)

(52) U.S. Cl.
CPC ..... *E04B 1/84* (2013.01)

(58) Field of Classification Search
CPC ..... E04B 1/342; E04B 2001/8452
USPC ..... 181/287
See application file for complete search history.

(56) References Cited

U.S. PATENT DOCUMENTS

| | | | | | |
|---|---|---|---|---|---|
| 4,972,633 | A * | 11/1990 | Wright | 52/27 |
| 5,044,103 | A * | 9/1991 | Izenberg | 40/617 |
| 5,992,561 | A * | 11/1999 | Holben et al. | 181/295 |
| 7,296,653 | B1 * | 11/2007 | Smith, Jr. et al. | 181/155 |
| 7,565,951 | B1 * | 7/2009 | Perdue | 181/287 |
| 8,944,209 | B1 * | 2/2015 | Fields | 181/178 |
| 2008/0086964 | A1 * | 4/2008 | Hardt | 52/239 |
| 2012/0325122 | A1 * | 12/2012 | Childers et al. | 108/32 |

* cited by examiner

*Primary Examiner* — Forrest M Phillips
(74) *Attorney, Agent, or Firm* — Shannon L Warren

(57) ABSTRACT

The instant art comprises a bracket that can be easily broken down into a substantially flat sheet, and a panel, both of relatively small volume, thereby enabling easy storage and/or transport. The combination is easily installed or removed and the panel is easily attached to the bracket and/or removed from the bracket. Said combination may modify the acoustical properties of an area.

17 Claims, 11 Drawing Sheets

DEVICE FOR ACOUSTICAL CHARACTERISTICS MODIFICATION

CROSS REFERENCE TO RELATED APPLICATIONS

Not applicable.

STATEMENT REGARDING FEDERALLY SPONSORED RESEARCH OR DEVELOPMENT

Not applicable.

DESCRIPTION OF ATTACHED APPENDIX

Not applicable.

BACKGROUND OF THE INVENTION

The invention relates to modification of acoustical properties of an area or enclosure. Especially, the inventions concerns components which can be assembled and affixed in operative position to a wall and/or a ceiling of an enclosure.

Devices and/or systems to improve the acoustical properties of enclosures by eliminating distortional effects such as echoes, reverberations, amplified bass tones, uneven volume distribution, nodes, etc. are known. However, extant devices generally employ large volume panels that attach to walls or employ floor standing structures. Such panels and related structures are usually of bulky, heavy, and expensive construction. They are difficult and expensive to install, remove, transport and/or store. Such large and/or floor standing devices also substantially reduce usable space, especially floor space, within an enclosure.

The instant art comprises a bracket that can be easily broken down into a substantially flat sheet, and a panel, both of relatively small volume, thereby enabling easy storage and/or transport. The combination is easily installed or removed and the panel is easily attached to the bracket and/or removed from the bracket.

The instant technology, by providing less bulky devices that are more easily deployed, more easily removed, more easily transported and/or more easily stored, while remaining equally as effective as previous technology, significantly advances the art.

BRIEF SUMMARY OF THE INVENTION

The primary object of the invention is to provide a system for modifying the acoustic quality of an area or enclosure such as a concert hall.

Yet another object of the invention is to provide device that is easily assembled, disassembled, transported and/or stored.

Another object of the invention is to provide modification of acoustical properties without detracting from usable floor space.

Another object of the invention is to provide an inexpensive acoustic modification device.

Still another object of the invention is to provide a bracket and acoustical panel combination mountable on a wall or ceiling.

A yet additional object of the invention is to provide an acoustical device equipped with a mounting, bracket whereby variation of the orientation of the bracket will vary the orientation of the panel relative the surface of an enclosure.

A further object of the invention is to provide a non-complex device for modification of acoustical properties of an area or enclosure.

Yet another object of the invention is to provide an acoustical device which comprises sound absorption elements and alternatively or concurrently sound reflective elements.

Still yet another object of the invention is to provide an acoustical device comprising a low frequency trap.

Other objects and advantages of the present invention will become apparent from the following descriptions, taken in connection with the accompanying drawings. wherein, by way of illustration and example. an embodiment of the present invention is disclosed.

In accordance with a preferred embodiment of the invention, there is disclosed a device for modification of acoustical properties of a space or enclosure comprising: a bracket, and an acoustic panel.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF NUMBERED COMPONENTS

Figure 1:
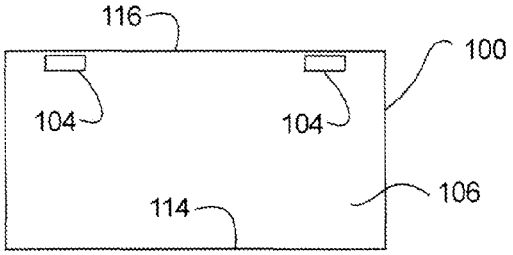
FIG. 1 is a front view of a bracket of the invention.

100 Bracket
102 Mounting tab
104 Mounting slot
106 First wall
108 First wall height
110 First wall base
112 Second wall
114 Second wall height
116 First wall edge
118 Second wall base
120 Second wall base
122 Side wall
124 Side wall first end
126 Side wall first end height
128 Side wall second end
130 Side wall second end height
132 Side wall base
134 Side wall edge
136 Bracket blank
138 Score
140 Tab
142 Slot
144 Slit
146 Flap
148 Panel
150 Mounting surface
152 Wall
154 Ceiling
156 Mounting hook
158 Mounting clip
160 Side wall declination
162 Side wall declination able
164 Tray
166 Side wall second end extension
168 Back wall
170 Enclosure
172 Screw
174 Floor
178 Gravity
180 Body portion
182 Mounting tab assembly
184 Mounting tab shank
186 Bracket/panel combination
188 Access hole
190 Enclosure inner surface
192 Bracket aperture
194 Bracket space
196 Frequency trap
198 Chamber
202 Low frequency trap

DETAILED DESCRIPTION OF THE PREFERRED EMBODIMENTS

Detailed descriptions of the preferred embodiment are provided herein. It is to be understood, however, that the present invention may be understood in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

The art of acoustics is well known. Therefore, principles thereof will be mentioned and or explained only to the extent required to teach one skilled in the art to use the present invention, and words having multiple definitions will be defined as they are commonly used in the art unless otherwise specified or made obvious by the context.

The word "occlude" and its forms shall not be limited to defining a total blockage but may mean partial blockage.

The word "chamber" and its forms shall not be limited to defining a completely enclosed space but may define a partially enclosed space.

FIG. 1, FIG. 2, FIG. 3, and FIG. 4 show a bracket having a back wall (168), a first wall (006) having an edge (116), an opposing second wall (110) having an edge (120), and one or more opposing side walls (122) each having an edge (134) with the back wall (168) comprising a base (109) for the first wall (106), a base (118) for the second wall (110), and a base (132) for the one or more side walls (122). The first wall (106) has a height (108) extending from the first wall base (109) to the first wall edge (116). The second wall (110) has a height (112) extending from the second wall base (118) to the second wall edge (120). The side walls (122) have first ends (124) having heights (126) extending from the side wall base (132) to the side wall edge (134). The side wall second ends (128) have heights (130) extending from the side wall base (132) to the side wall edge (134).

Figure 3:
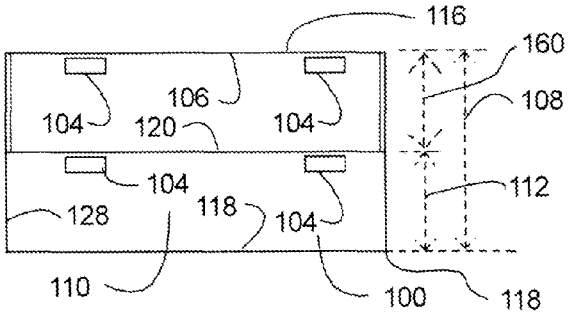
FIG. 3 is back view of a bracket of the invention.
Figure 2:
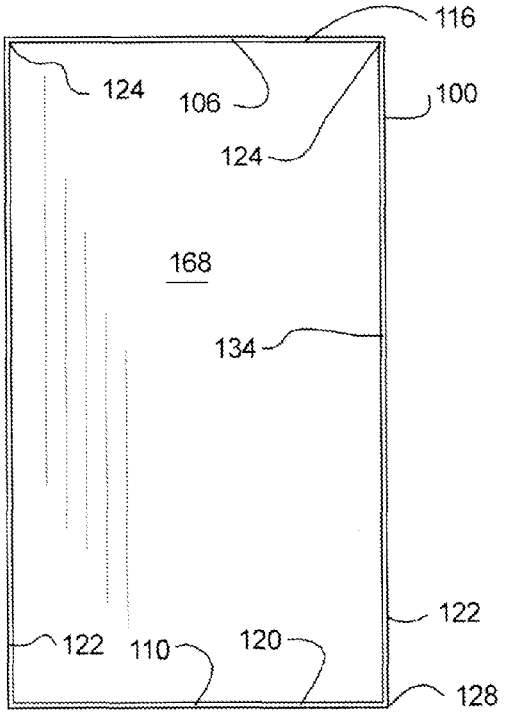
FIG. 2 is a top view of a bracket of the invention.
Figure 4:
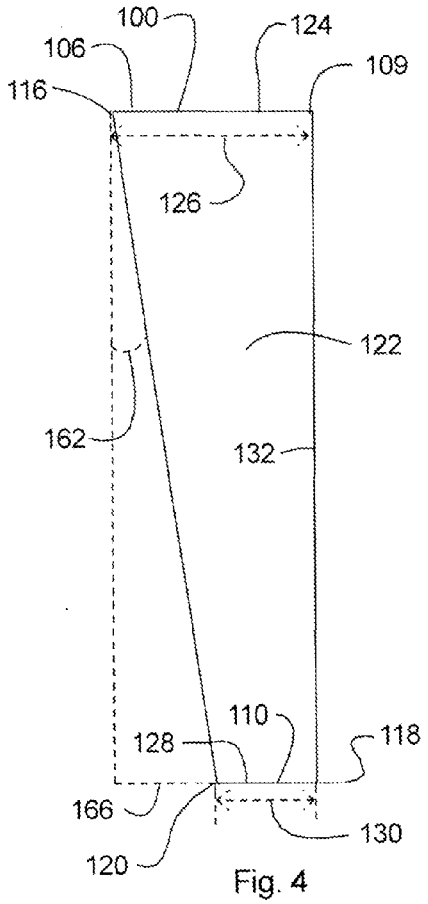
FIG. 4 is a side view of a bracket of the invention.
Figure 5:
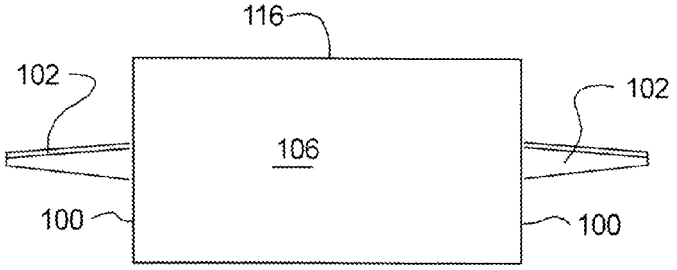
FIG. 5 is a front view of a bracket of the invention.
Figure 6:
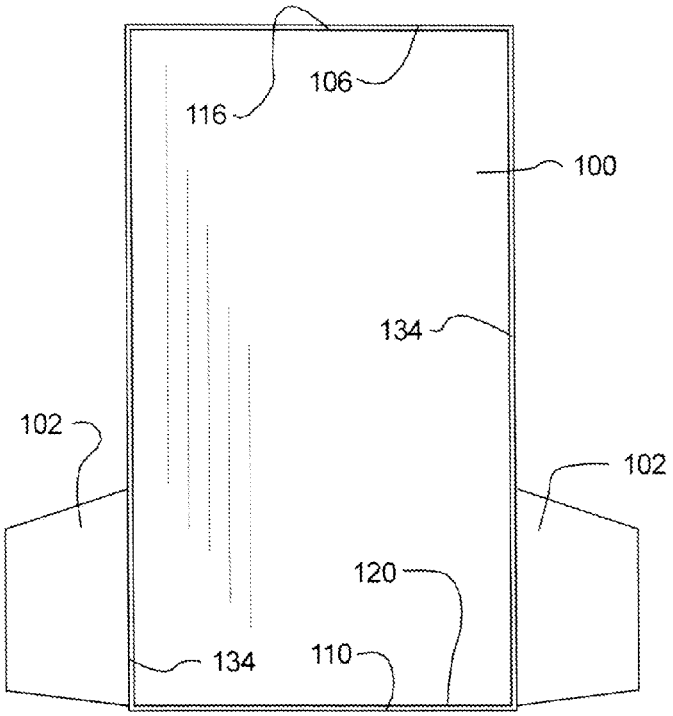
FIG. 6 is a top view of a bracket of the invention.
Figure 8:
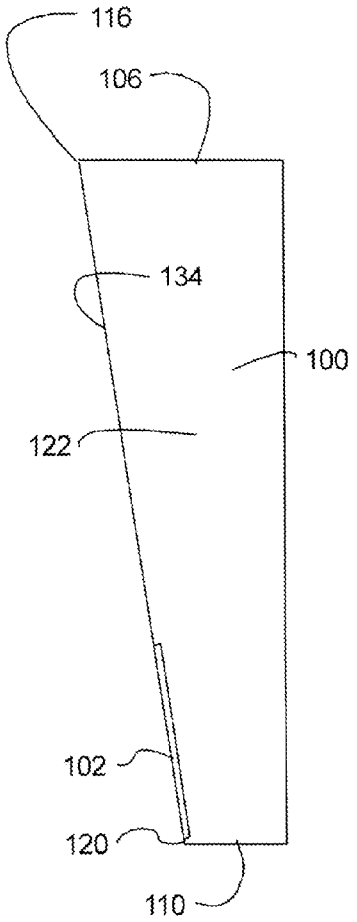
FIG. 8 is a side view of a bracket of the invention.
Figure 7:
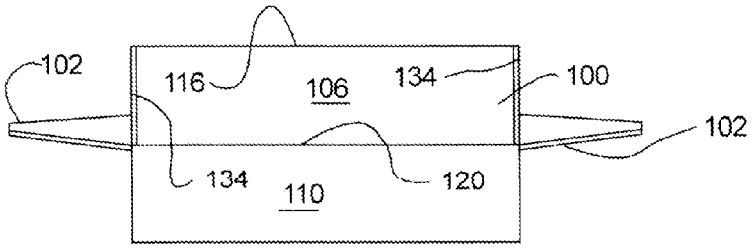
FIG. 7 is back view of a bracket of the invention.
Figure 9:
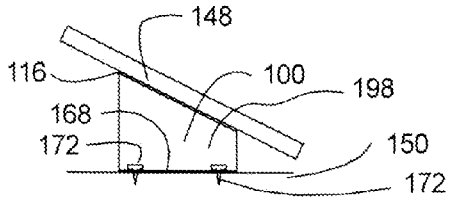
FIG. 9 is a top view of a bracket and panel of the invention.
Figure 10:
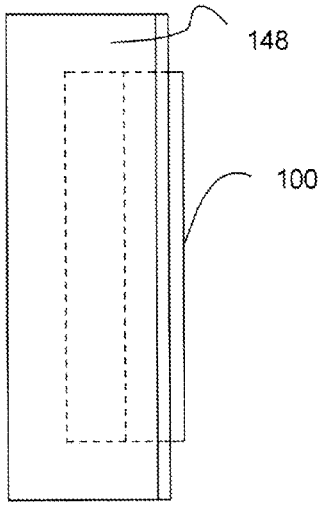
FIG. 10 a side view of a bracket and a panel of the invention.

FIG. 3 and FIG. 4 show that the first wall height (108) may be greater than the second wall height (t 12) and that the side wall first end height (126) may be greater than the side wall second end height (130). Therefore, the side walls (122) may comprise declinations (160) from the side wall edge (134) at the sidewall first end (124) to the side wall edge (134) at the side wall second end (128). Said declinations may comprise an angle (162) from the perpendicular from said sidewall first end (124) to an extension (166) of the side wall second end (128).

FIG. 9, FIG. 11, FIG. 13 and FIG. 14 show the bracket (100) with the back wall (168) essentially contiguous a mounting surface (150), in example a wall (152), ceiling (154), or floor (174) of an enclosure, and show, that said back wall (168) may be affixed to said mounting surface (150) by any suitable attachment means, in example screws (172).

One skilled in the attachment art will readily appreciate that said suitable attachment means, in example screws (172) may be quickly and easily installed and/or be quickly and easily removed thus enabling easy and quick installation of the bracket (100).

FIG. 9, FIG. 10, FIG. 11, FIG. 12, FIG. 13, and FIG. 14 show that a panel (148) and the bracket (100) may comprise a combination where the panel (148) may be disposed relative to the bracket (100) so as to be essentially contiguous with the first wall edge (116), second wall edge (120) and/or the side wall edges (134).

Said disposition may be fixed by any suitable means. In example, as shown in FIG. 1, FIG. 3, FIG. 15, and FIG. 16, the bracket (100) may have mounting slots (104) positioned in the first wall (106) proximal the first wall edge (116) and in the second wall (110) proximal the second wall edge (120). The panel (148) may comprise mounting hooks (156) disposed such that said hooks (156) may extend through said mounting slots (104). Therefore, it will be readily appreciated that said mounting hook (156) and mounting slot (104) engagement will prevent movement of the panel (148) relative the bracket (100).

Figure 17:
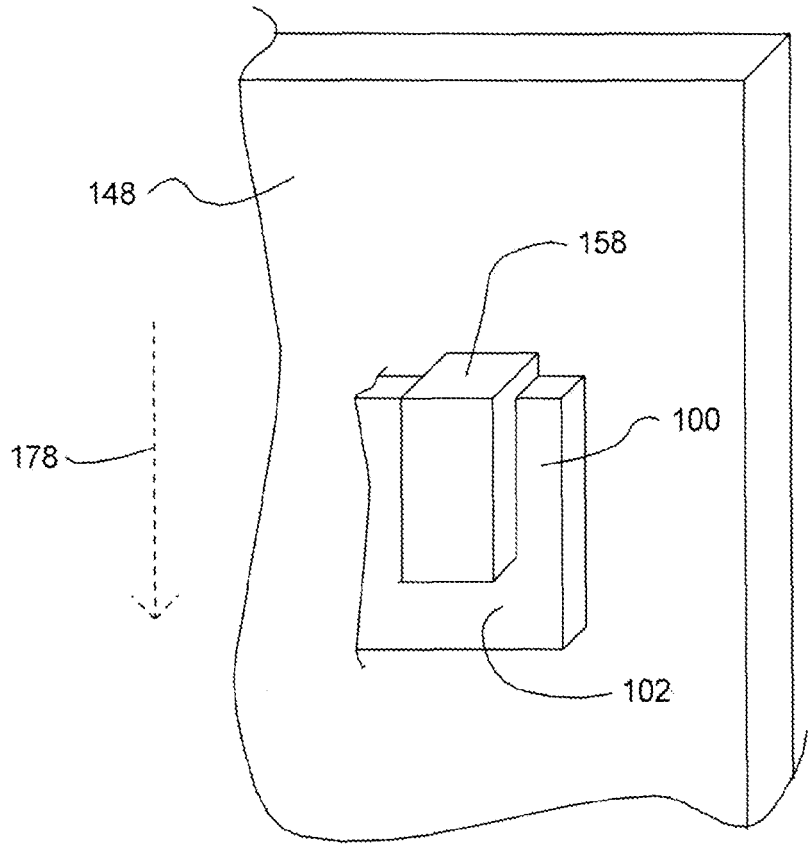
FIG. 17 is a perspective view of a means for attachment of a panel to a bracket of the invention.
Figure 18:
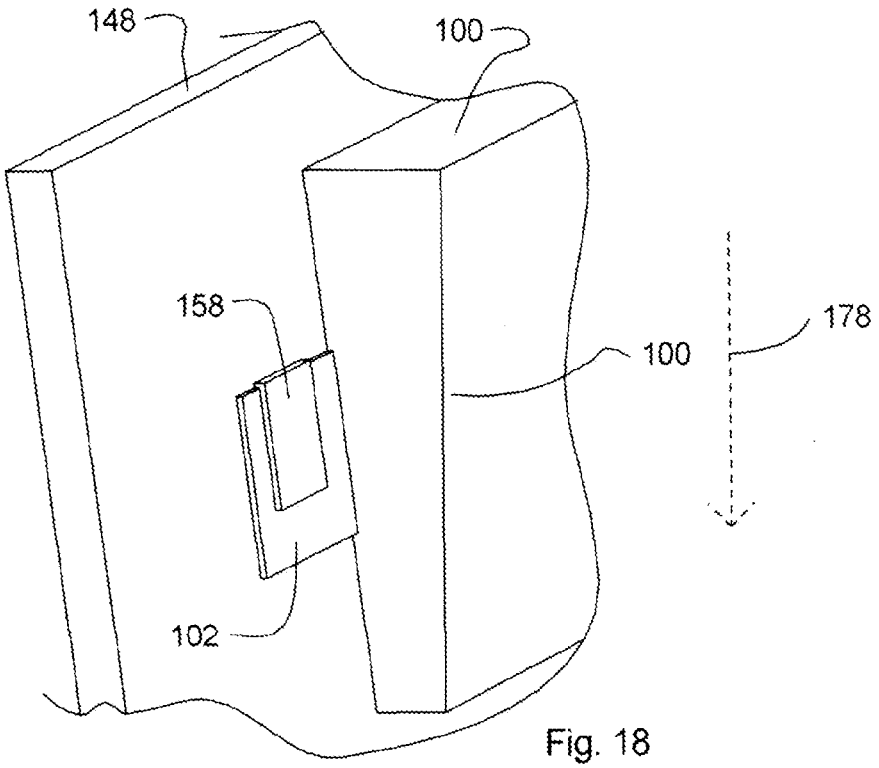
FIG. 18 is a perspective view of a means for attachment of a panel to a bracket of the invention.
Figure 21:
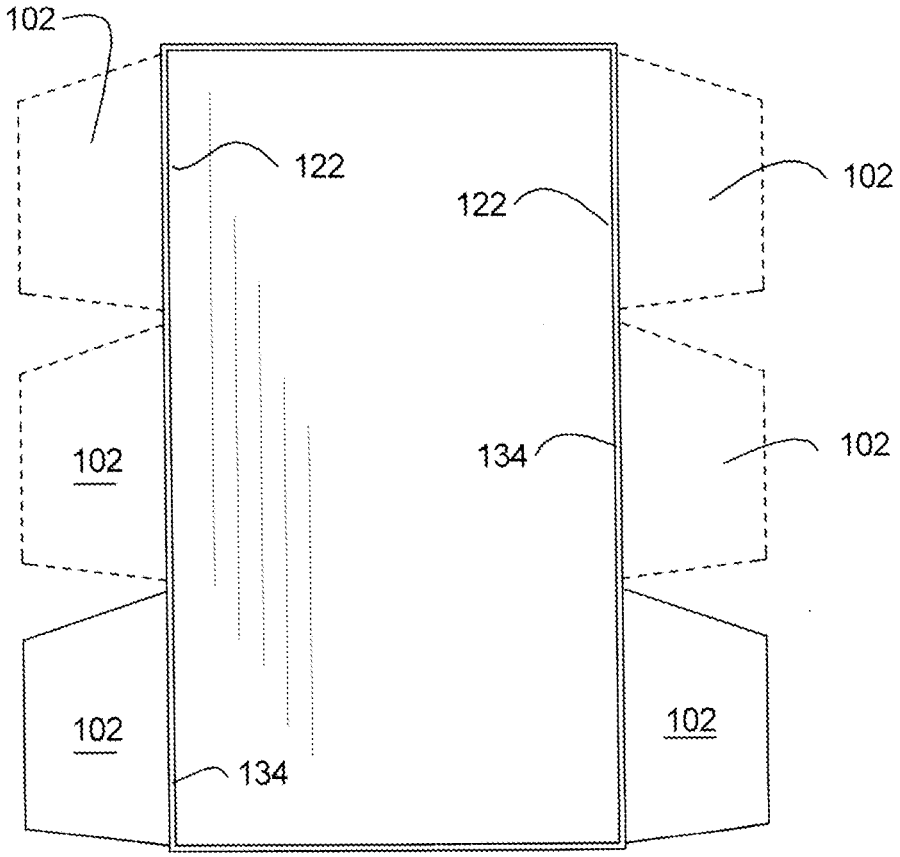
FIG. 21 is a top view of a bracket of the invention with alternative bracket tab positions depleted by broken lines.

Alternatively, as shown in FIG. 5, FIG. 6, FIG. 7, and FIG. 8, the bracket (100) may comprise mounting tabs (102) extending from the side wall edges (134) essentially normal the side walls (122). Said mounting tabs (102) may be disposed in various positions relative said side wall edges (134) as shown in FIG. 21. The panel (148) may have mounting clips (158) oriented such that the mounting tabs (102) may be inserted into said clips (158) as shown in FIG. 17 and FIG. 18. The mounting clips (158) may be biased to enhance a friction fit between said clips (158) and said mounting tabs (102). Therefore, it will be readily appreciated that said mounting tab (102) and mounting clip (158) engagement will prevent movement of the panel (148) relative the bracket (100).

Figure 19:
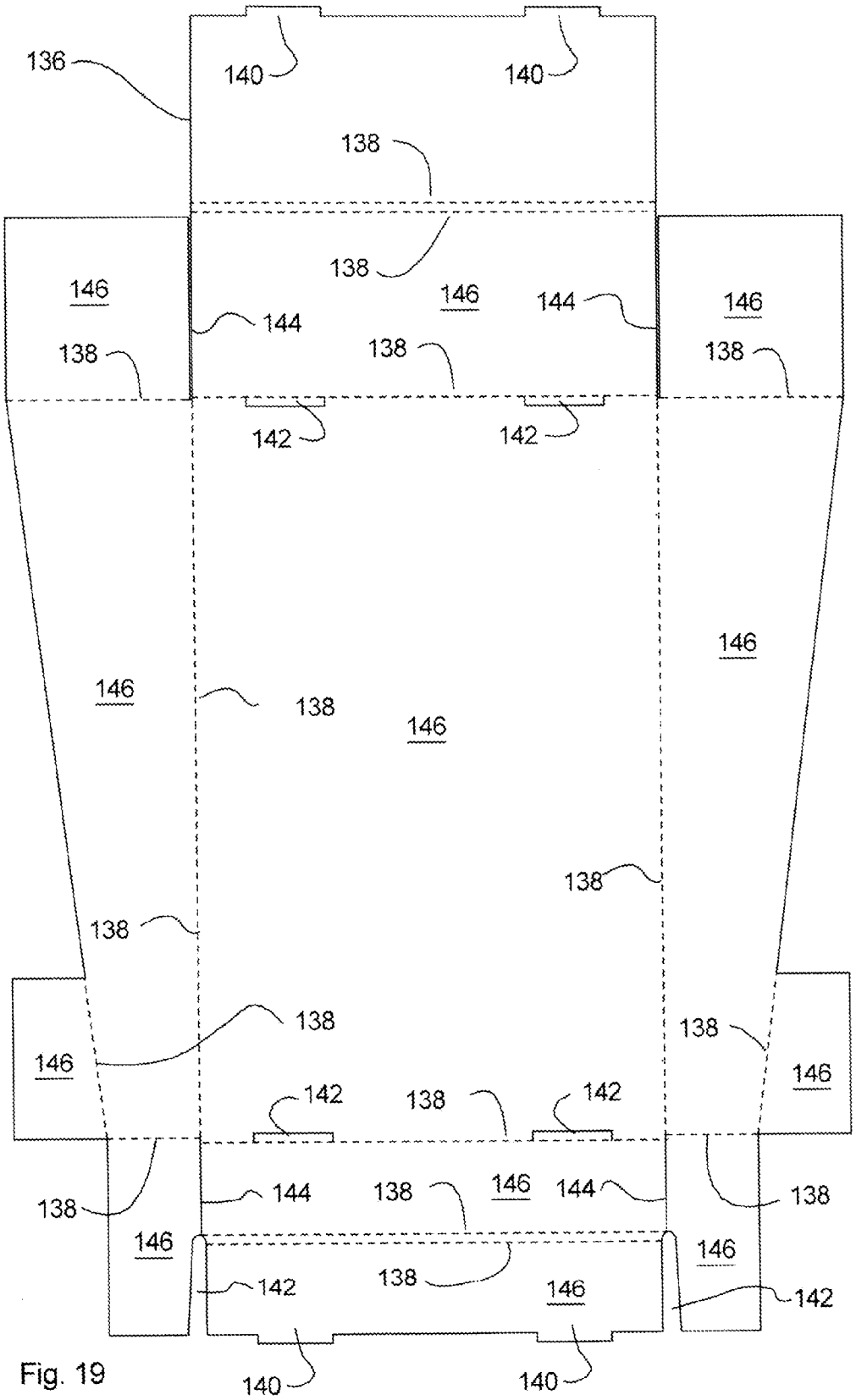
FIG. 19 is a top view of a bracket blank of the invention.
Figure 19A:
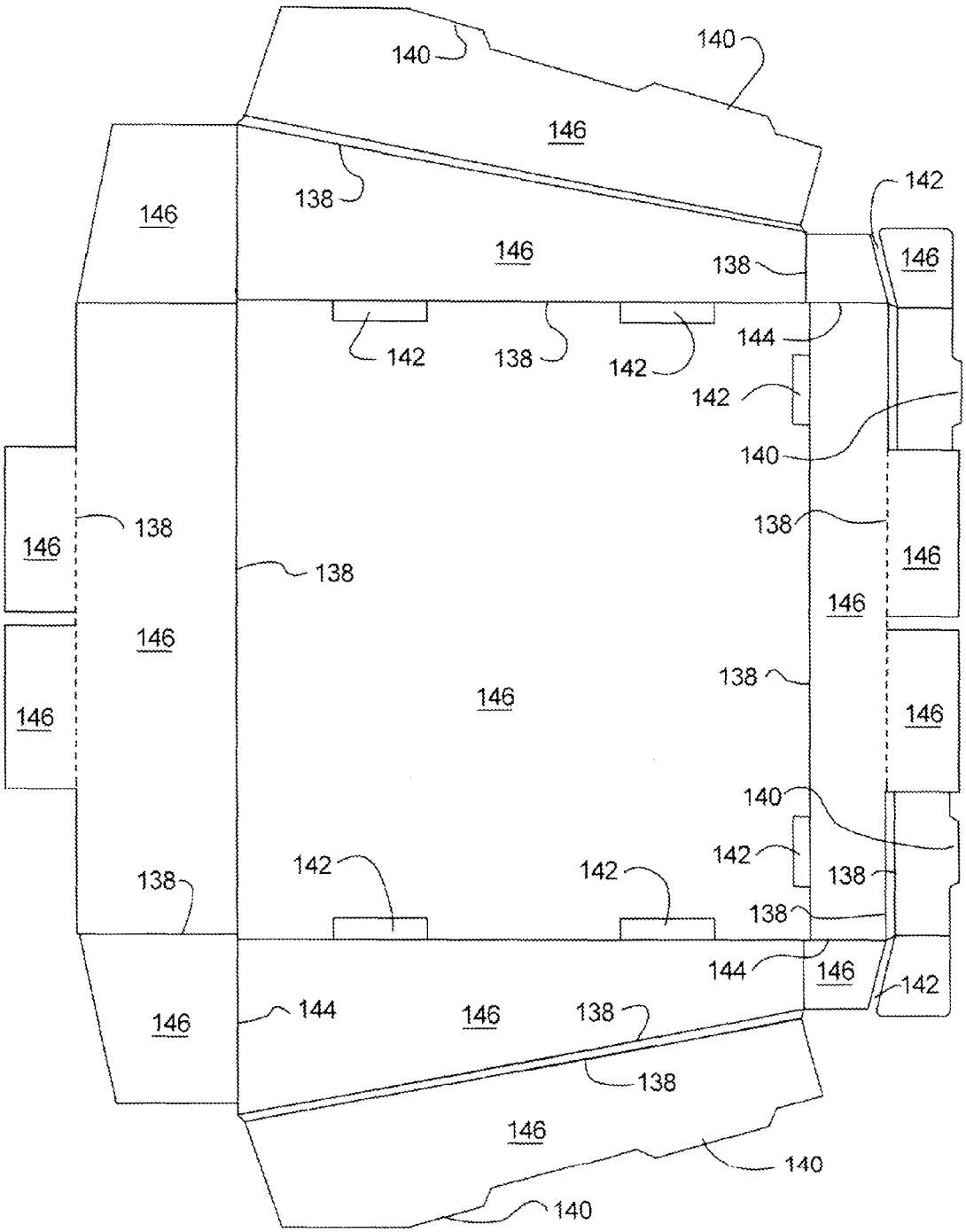
FIG. 19A is a top view of a bracket blank of the invention.

FIG. 19 and FIG. 19A show that the bracket (100) may comprise a bracket blank (136) comprising any suitable material, in example, corrugated kraft or plastic sheets, having liners or corrugated medium or corrugated twin-wall plastic panels. Said blank (136) may have scores (138), slots (142), silts (144), and tabs (140) which may comprise, flaps (146) and body portions (180) such that said blank (136) may be folded to comprise the previously described bracket (100). Also, it will be understood that the bracket (100) may be manipulated or unfolded to comprise the original blank (136). In addition, though the bracket blank (136) is depicted as being substantially planar with length and depth substantially greater than its depth, the bracket blank (136) may comprise any configuration manipulatable to comprise a suitable bracket (100).

Figure 20:
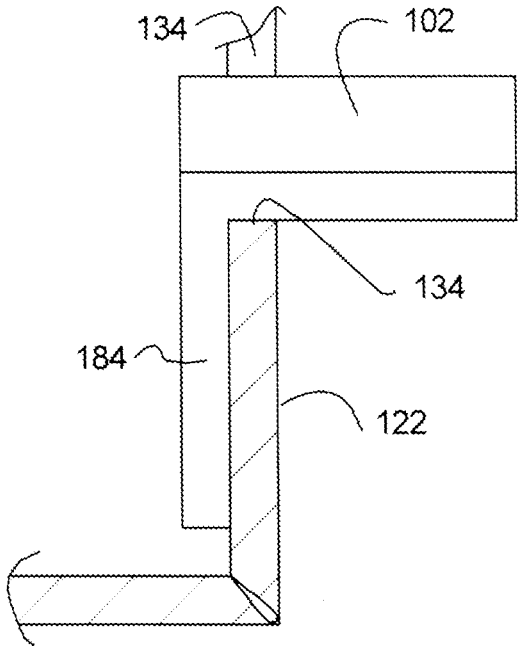
FIG. 20 is a back view of attachment of a bracket tab to the bracket of the invention with the bracket shown in cross section.

FIG. 20 shows that the mounting tab (102) extending substantially normal the side walls (122) need not comprise material common to said side wall (122) and defined by a score (138) as shown in FIG. 19 and FIG. 19A but may comprise a separate assembly (182) comprising mounting tab (102) and a mounting shank (184) oriented relative said mounting tab (102) such that said shank (184) may be affixed to the side wall (122) so that said mounting tab (102) extends from the side wall edge (134) as previously described.

Figure 22:
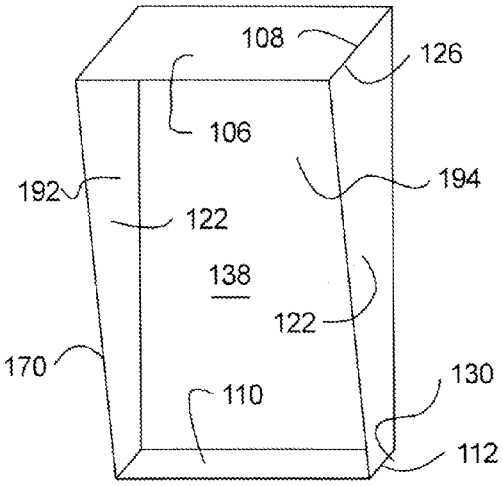
FIG. 22 is a top view of a bracket of the invention.

FIG. 22 illustrates that the bracket (100) comprises a tray (164) having the back wall (168), the first wall (106) the second wall (110), and the side walls (122), said bracket (100) thusly configured having a bracket space (114) defined thereby and a bracket aperture (192) opposite the back wall (138).

FIG. 9, FIG. 10, FIG. 11, FIG. 12, FIG. 13, FIG. 14, FIG. 15, and FIG. 16 illustrate that when the bracket aperture (192) is occluded by the panel (148) as previously described, the panel (148) and the bracket (100) in combination comprise a chamber (198) defined by said panel (148), said first wall (106), said second wall (110), said side walls (122), and said back wall (138).

Figure 11:
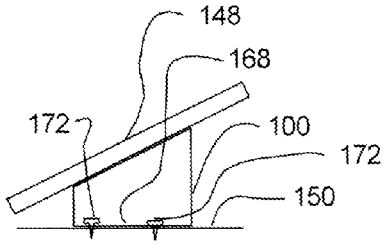
FIG. 11 is a top view of a bracket and a panel of the invention.
Figure 12:
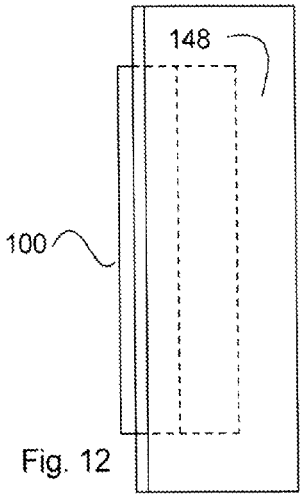
FIG. 12 is a side view of a bracket and a panel of the invention.
Figure 13:
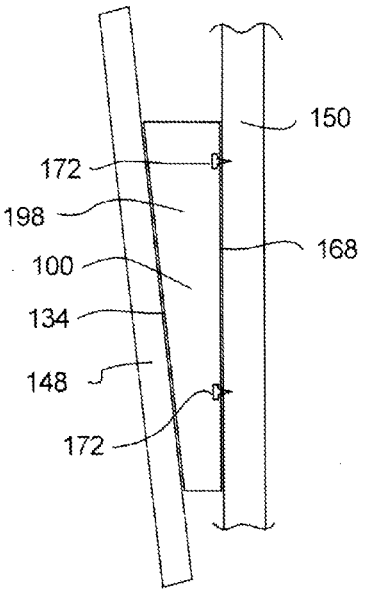
FIG. 13 is a top view of a bracket and a panel of the invention.
Figure 14:
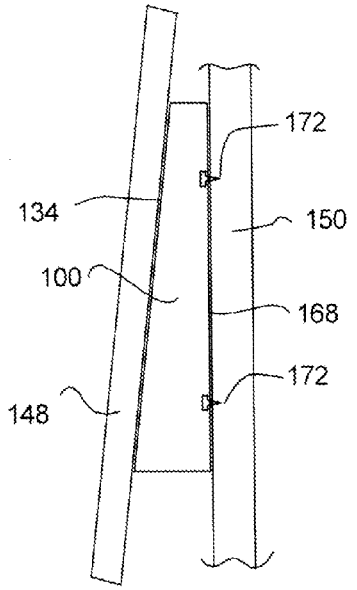
FIG. 14 is a top view of a bracket and a panel of the invention.
Figure 15:
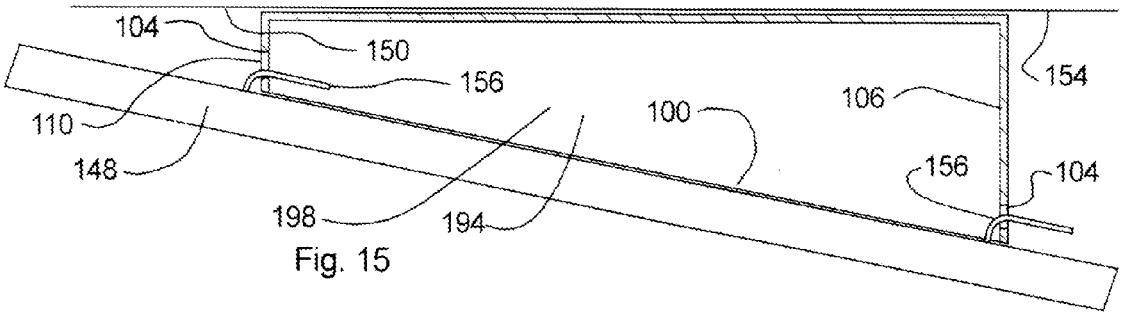
FIG. 15 is a side view of a bracket and a panel of the invention with the bracket shown in cross section.
Figure 29:
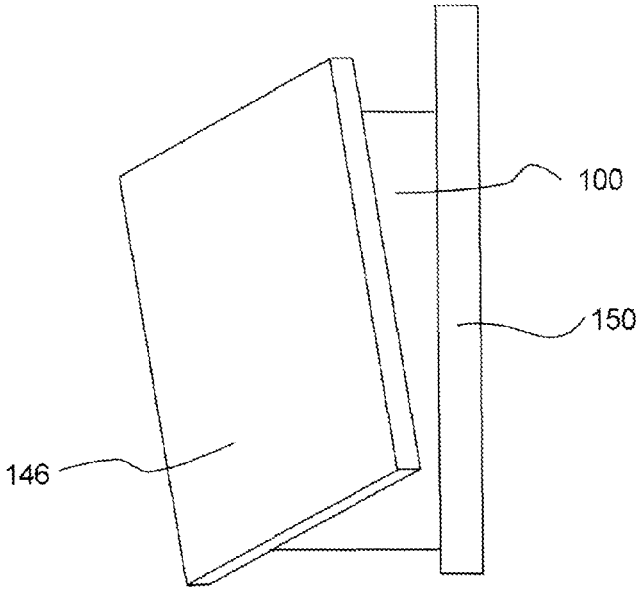
FIG. 29 is a side view of a bracket and a panel of the invention in operative position.
Figure 30:
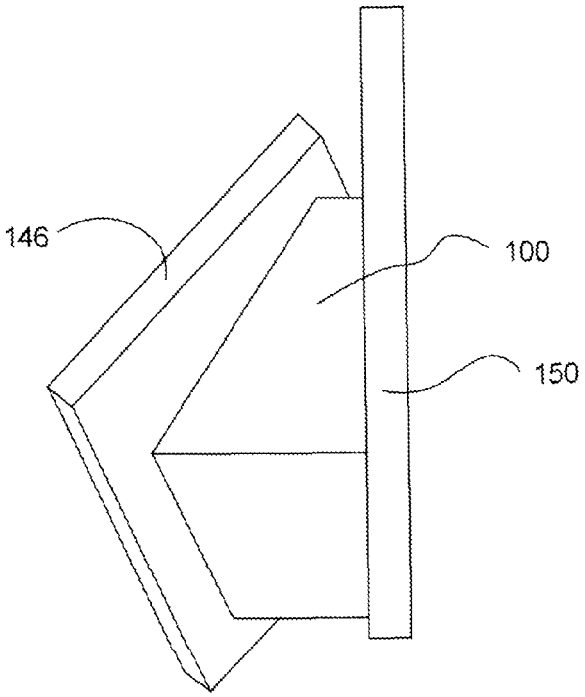
FIG. 30 is a side view of a bracket and a panel of the invention in operative position.

Turning again to FIG. 9, FIG. 12, FIG. 13, FIG. 14, FIG. 22, FIG. 23, FIG. 24, FIG. 25, FIG. 26, FIG. 27, and considering FIG. 29 and FIG. 30, it will be readily appreciated that by manipulation of the dimensions of the bracket (100), as previously described, and/or varying the orientation of the bracket (100) relative the mounting surface (150), as shown in FIG. 9, FIG. 11, FIG. 13, and FIG. 14 the panel (148) in the bracket/panel combination (186) may be disposed in sundry orientations relative the mounting surface (150). Therefore, bracket/panel combinations (186) may be contrived having varying sound reflective and/or sound absorptive properties. In addition, by manipulation of the dimensions of the bracket (100). as previously described, chambers (198) having various configurations and/or volumes may be created.

It will be understood that, although the panel (148) is depicted as being substantially planar and as having a small depth relative to its length and width, the panel may have any configuration that sufficiently occludes the bracket aperture (192) to enable the low frequency sound trap (202).

Now, one will readily appreciate that the panel (148) may comprise properties conducive to altering the acoustic properties of an enclosure (170), in example sound absorptive or sound reflective properties. Also, in combination with the bracket (100) and by means of said bracket (100), said combination (186) with said bracket (100) affixed to a mounting surface (150), in example a wall (152), a ceiling (154), or a from (174), the panel (148) may be disposed in operative position within an enclosure (170), as seen in FIG. 28.

In addition, tht, bracket (100) and/or the panel (148) may comprise materials so that the chamber (198) will serve as a sound trap (202). Thus, the result that the bracket/panel combination (186) yields enhanced acoustic modification properties not found in an acoustic panel by itself or with any other known type of mounting means.

Figure 28:
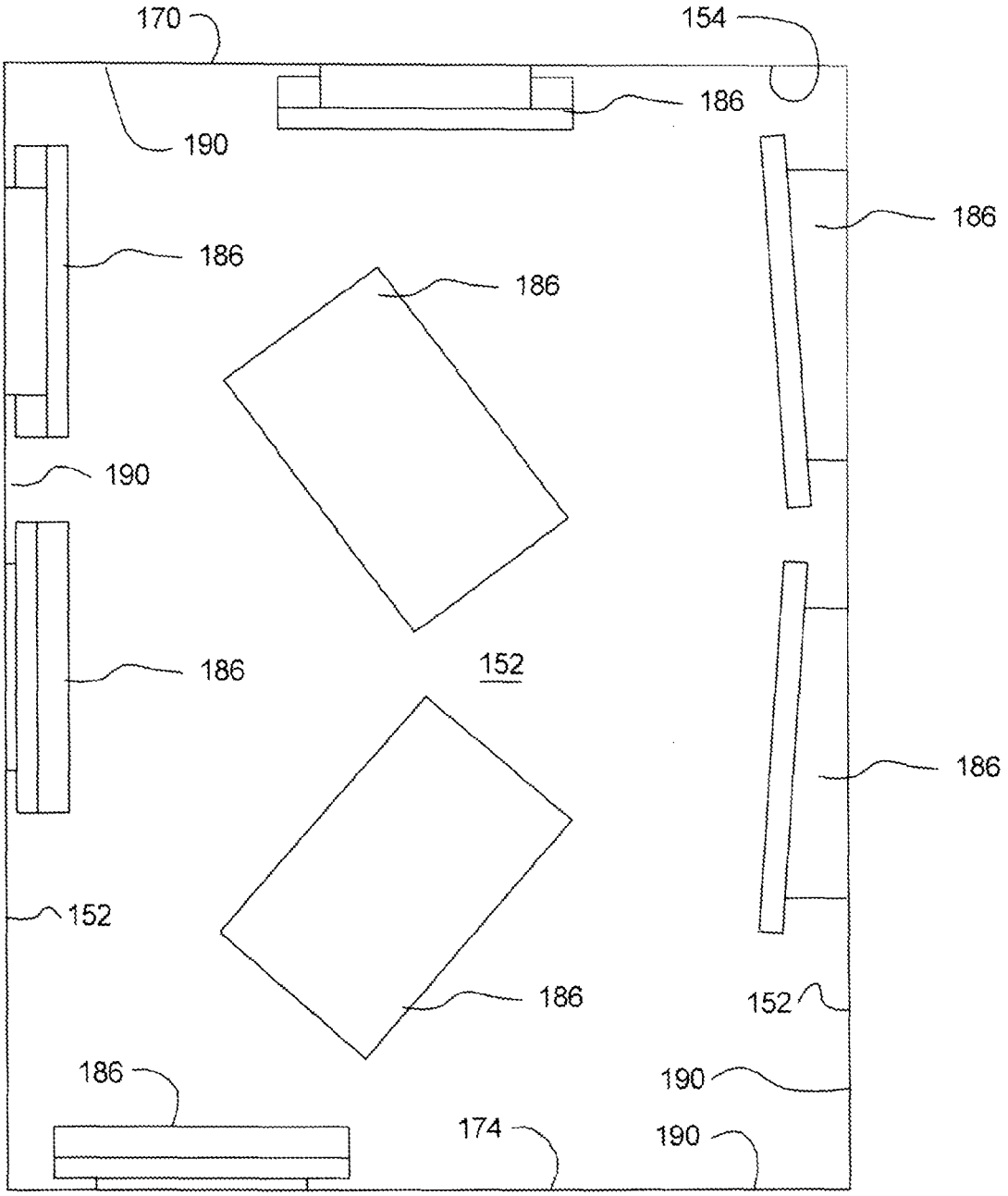
FIG. 28 is a view of brackets and panels of the invention in operative position.

Therefore, one skilled in the art will readily appreciate that one or more brackets (100) in combination with panels (148) may be cunningly disposed about the walls (152), floor (174) and/or ceilings (154) as shown in FIG. 28 so as to alter the acoustic properties of an enclosure (170) to conform to desired parameters. In example, indoor rooms intended primarily for listening to music, whether residential rooms used for watching television or listening to recorded music, or public auditoria, or enclosures employed for listening to live music may be contrived such that sound produced therein will be essentially uniform throughout said enclosures.

One skilled in the art will readily appreciate that the breaking down of the bracket (100) into the bracket blank (136) and the dimensional characteristics of the panel (148) will facilitate the transportation and/or storage of elements of the functional combination (186).

The bracket/panel combination (186) may decrease reverberation times at desired frequencies, may reduce nodes throughout an enclosure thusly affecting uniformity of sound intensity, and remove echoes and overly intense or sustained bass sounds.

Figure 27:
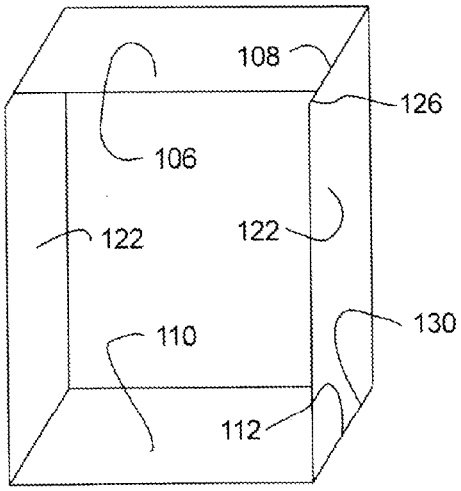
FIG. 27 is a top view of a bracket of the invention.

It will be understood that although the first wall height (108) and side wall first end height (126) has been depicted as being essentially greater than the second wall height (112) and the side wall second end height (130) so that the side wall declination angle (162) is substantially acute, the first wall height (108) and the side wall first end height (126) and the second wall height (112) and the side wall second end height (130) may be essentially equal so that the sick wall declination angle (162) is essentially 180°, as shown in FIG. 27.

Figure 25:
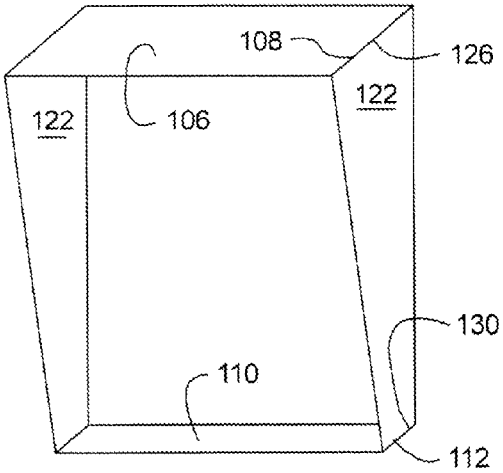
FIG. 25 is a top view of a bracket of the invention.
Figure 23:
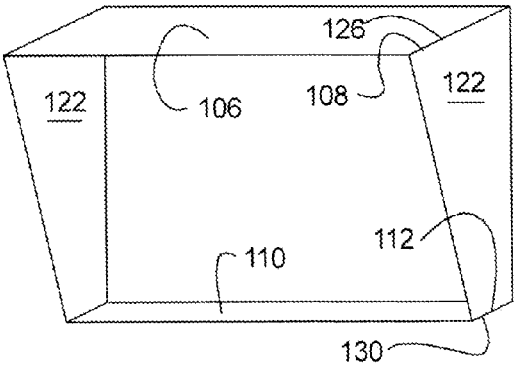
FIG. 23 is a top view of a bracket of the invention.

It will also be noted that although the side walls (122) have been depicted as being essentially longer than the first wall (108) and the second wall (110) the side walls (122) may be essentially equal in length to the first wall (106) length and second wall (110) length as shown in FIG. 25, or the side walls (122) may be shorter in length than the first wall (106) and the second wall (110) as shown in FIG. 23.

Figure 26:
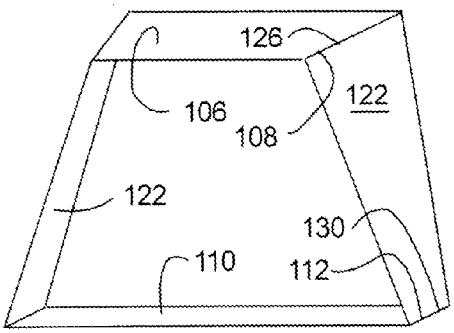
FIG. 26 is a top view of a bracket of the invention.
Figure 24:
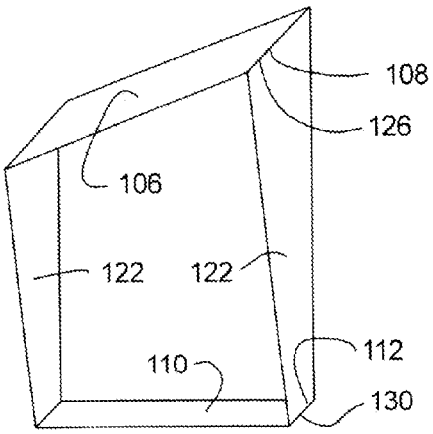
FIG. 24 is a top view of a bracket of the invention.

It will be readily appreciated that although the first wall (106) and the second wall (110) have been depicted as being essentially equal in length, the first wall (106) and the second wall (110) may differ in length as shown in FIG. 26 and FIG. 24.

It will be realized that although the side walls (122) have been depicted as essentially equal in length, the side walls (122) may have unequal lengths as depicted in FIG. 24.

Figure 16:
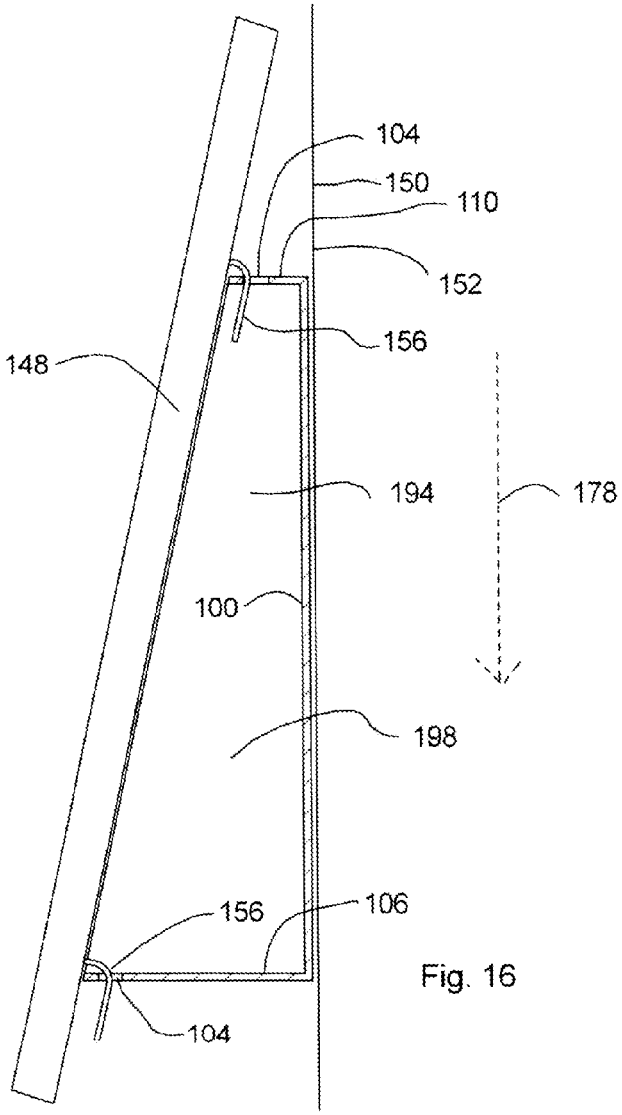
FIG. 16 is a side view of a bracket and a panel of the invention with the bracket shown in cross section.

FIG. 16 depicts that the bracket/panel combination (186) may be oriented so that gravity (178) will force the mounting hooks (156) through the mounting slots (104) thusly seating said mounting hooks against the first wall (106) and/or the second wall (110).

FIG. 17 and FIG. 18 illustrate that the bracket/panel combination (186) may be oriented so that gravity (178) will force the mounting clips (158) to seat against the mounting tabs (102).

FIG. 27 shows that the heights, in example first wall height (108) and second wall height (1112), of adjacent walls, in example the first wall (106) and the sidewall (122), need not be equal.

Figure 31:
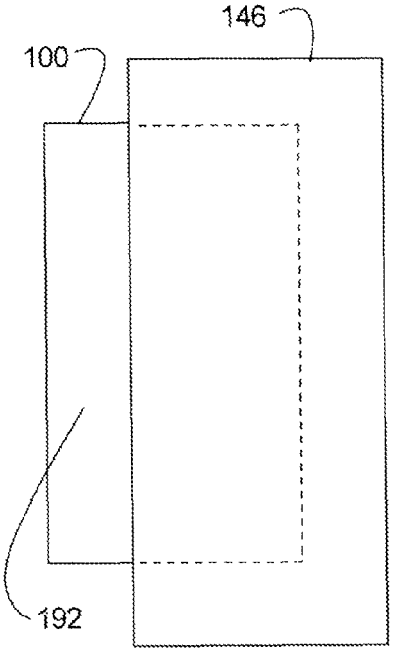
FIG. 31 is a top view of a bracket and a panel of the invention.
Figure 32:
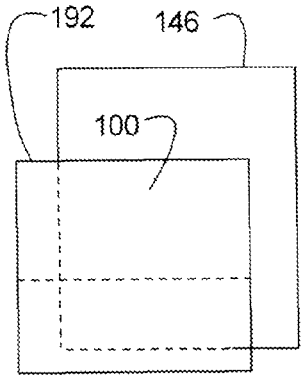
FIG. 32 is a front view of a bracket and a panel of the invention.

FIG. 31 and FIG. 32 show that the panel (148) when combined with the bracket (100) need not totally occlude the bracket aperture (192) Therefore, said unblocked portion of aperture (192) may comprise an access hole (188) in the bracket/panel combination (186). Now, one skilled in the art will readily appreciate that the area of said access hole (188) may be variable by alteration of the position of said panel (148) relative said bracket (100) as can be seen in FIG. 31 and FIG. 32. Therefore, one skilled in the art will readily appreciate that intensity levels and/or frequencies of sound trapped by the frequency trap (202) may be varied.

To use the depicted embodiment of the device, the bracket blank (136) is manipulated to comprise the bracket (100). The bracket (100) is attached to the mounting surface (150). Then, the panel (148) is attached to the bracket (100). Therefore, it will be understood that the bracket (100) may be configured to orient the bracket relative the mounting surface (150). Further, it will be realized that the bracket (100) is convertible to a frequency trap (202) by occlusion of the bracket aperture (192) by the panel (148) and that in combination (186), the bracket (100) and the panel (148) comprise a device having an ability to modify the acoustic properties of an environment.

It will be readily appreciated that the bracket (100) may be disengaged from the mounting surface (150) by reversing the previously described bracket (100) to mounting surface (150) procedure, in example by removing the screws (172) shown in FIG. 9, FIG. 11, FIG. 13, and FIG. 14). It will be further understood that the panel (148) may be disengaged from the bracket (100) by reversing the previously described panel (148) to bracket (100) fixation process shown in FIG. 2, FIG. 3, FIG. 15, and FIG. 16. Therefore, one skilled in the art will understand that when the bracket (100) is disengaged from the mounting surface (150) and the panel (148) is disengaged from the bracket (100) and the bracket (100) is unfolded to comprise the original bracket blank (136), as previously described, said elements (148 and 136) will comprise less volume than the bracket (100) and the panel (148) thusly facilitating storage and/or transport of the instant art.

While the invention has been described in connection with a preferred embodiment it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An assembly being adapted for acoustical characteristics modifications comprising:

a panel and a bracket; wherein, said bracket comprises an essentially planar blank with a scoring;

said scoring separates said essentially planar blank into flaps;

said bracket is configured to selectively fold along said scoring between an assembled configuration and a disassembled configuration;

said disassembled configuration comprises an essentially planar shape;

a portion of said flaps fold along said scoring to form at least a back wall, a plurality of side walls extending from said back wall, an aperture defined by said plurality of side walls extending from said back wall, and a space defined by said back wall and said plurality of side walls extending from said back wall; and said bracket, in said assembled configuration, is configured to selectively hold said panel.

2. The assembly as in claim 1 comprising a chamber created by occlusion of the aperture by the panel.

3. The assembly as in claim 1 wherein said bracket has sound reflective or, alternatively or concurrently, sound absorptive properties.

4. The assembly as in claim 1 wherein said panel is configured to selectively attach to said bracket; and said panel comprises sound reflective, or alternatively or concurrently, sound absorptive properties.

5. The assembly as in claim 2 wherein said chamber is configured to trap sound.

6. The assembly as in claim 1 wherein, said plurality of side walls comprise at least a first side wall and a second side wall;

said plurality of side walls extending various distances from the back wall;

said panel selectively attaches to said plurality of side walls of said bracket;

said back wall of said bracket selectively attaches to a mounting surface; and with said plurality of side walls being dissimilar, the angle and placement of said panel can be modified when mounted to said bracket.

7. The assembly as in claim 1 said plurality of side walls are substantially similar in dimensions; and said plurality of side walls are configured to extend a single distance from the back wall when said bracket is in said assembled configuration.

8. The assembly as in claim 1 comprising adjacent walls having lengths different from each other or, alternatively or concurrently, comprising opposing walls having lengths different from each other.

9. The assembly as in claim 1 attachable to an inner surface of an enclosure.

10. The assembly of claim 1 wherein, said panel comprises a one or more mounting hooks;

said bracket comprises a one or more mounting slots; and said panel selectively attaches to said bracket by sliding a portion of said one or more hooks into a portion of said one or more mounting slots.

11. The assembly of claim 10 wherein, said one or more mounting slots are positioned in said plurality of side walls.

12. The assembly of claim 10 wherein, said one or more mounting hooks comprise a first hook and a second hook;

said one or more mounting slots comprise at least a first slot and a second slot;

said first slot and said second slot are arranged across from one another on said plurality of side walls; and said panel is attached to said bracket in at least two locations with said one or more hooks into said bracket.

13. The assembly of claim 1 wherein, said panel comprises a one or more mounting clips;

said bracket comprises a one or more mounting tabs;

said mounting clips are biased to enhance a friction fit between said clips and said tabs;

said bracket and said panel are oriented so that a force of gravity will force the mounting clips to seat against the mounting tabs; and said mounting tab and said mounting clip are configured to prevent movement of said panel relative said bracket.

14. The assembly of claim 1 wherein, said essentially planar blank comprises a corrugated kraft or plastic sheets.

15. The assembly of claim 14 wherein, said plastic sheets of said essentially planar blank comprise corrugated medium.

16. The assembly of claim 14 wherein, said plastic sheets of said essentially planar blank comprise corrugated twin-wall plastic panels.

17. The assembly of claim 1 wherein, said assembly is selectively configured into sundry orientations relative a mounting surface so as to be contrived as having varying sound reflective and/or sound absorptive properties by manipulating a dimensions and an orientation of said bracket.

* * * * *